United States Patent [19]

Yasuda

[11] 3,980,224

[45] Sept. 14, 1976

[54] OPENING MEANS FOR CONTAINERS AND PACKAGES

[75] Inventor: Jyunichi Yasuda, Tokyo, Japan

[73] Assignee: Mitsubishi Petrochemical Company Limited, Tokyo, Japan

[22] Filed: Sept. 13, 1974

[21] Appl. No.: 505,695

[30] Foreign Application Priority Data

Sept. 13, 1973 Japan ..... 48-102654

[52] U.S. Cl. ..... 229/51 TS; 229/DIG. 5; 206/498; 206/484

[51] Int. Cl.[2] ..... B65D 5/70

[58] Field of Search ..... 229/51 TS, DIG. 5, 51 BP, 229/66, 85, 55; 206/484, 498; 53/305

[56] References Cited

UNITED STATES PATENTS

| | | | |
|---|---|---|---|
| 3,001,644 | 9/1961 | Fourness et al. | 206/498 |
| 3,298,593 | 1/1967 | Stephenson | 229/51 TS |
| 3,344,975 | 10/1967 | Stoker, Jr. | 229/51 TS |
| 3,368,740 | 2/1968 | Rohde | 229/51 TS |
| 3,402,873 | 9/1968 | Lauterbach, Jr. | 53/305 |
| 3,550,764 | 12/1970 | Tigner | 229/51 TS |
| 3,608,815 | 9/1971 | Bunch | 229/DIG. 5 |

*Primary Examiner*—William Price
*Assistant Examiner*—Joseph M. Moy
*Attorney, Agent, or Firm*—Sughrue, Rothwell, Mion, Zinn and Macpeak

[57] ABSTRACT

An opening means for containers and packages comprising a sheet containing at least one crystalline thermoplastic high molecular weight resin layer, the resin layer being partially uniaxially oriented, and a tab integrated with the sheet to be pulled up in the uniaxially oriented direction, the sheet being applied to that area or part of the containers and packages to be opened.

10 Claims, 4 Drawing Figures

FIG. 1
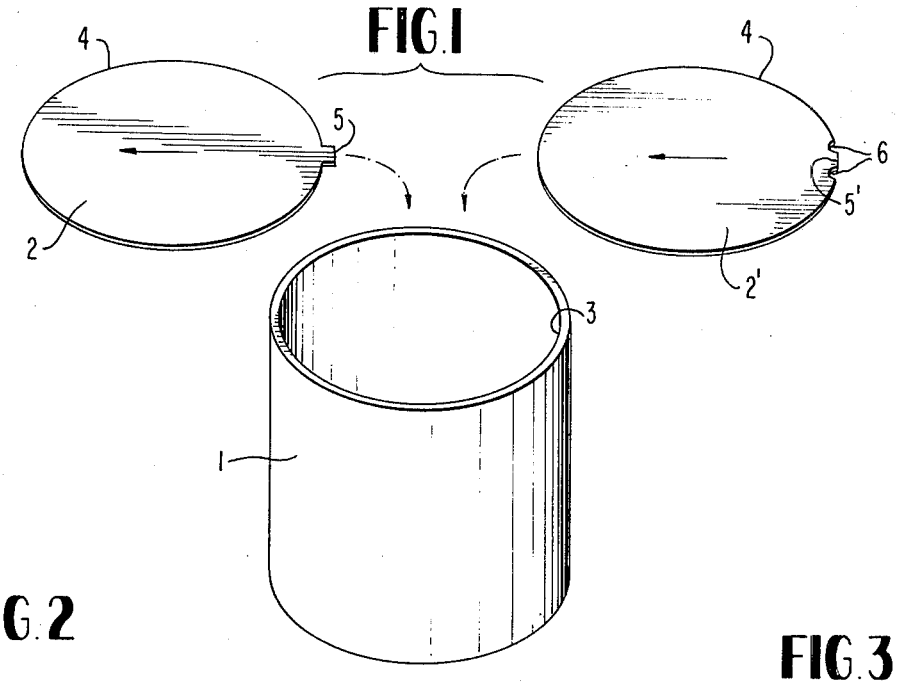
FIG. 2
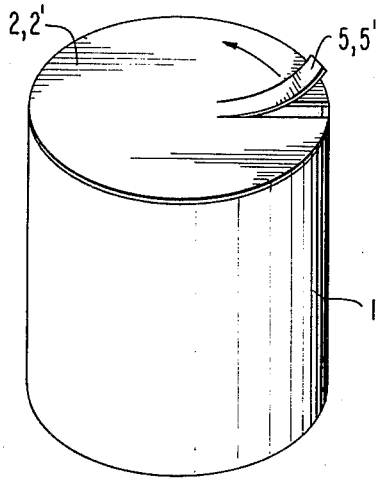
FIG. 3
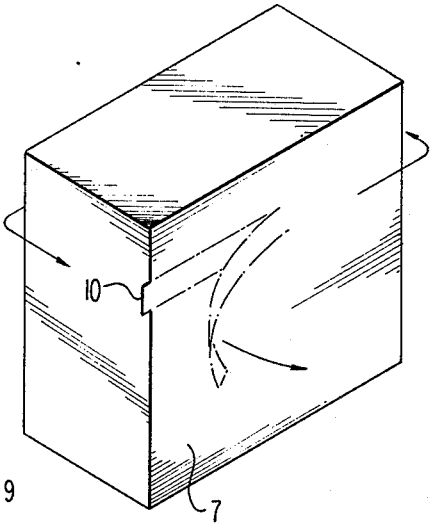
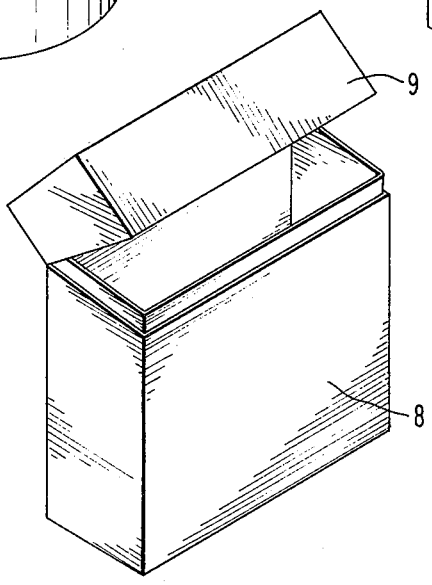
FIG. 4

OPENING MEANS FOR CONTAINERS AND PACKAGES

BACKGROUND OF THE INVENTION

1. Field of the Invention

This invention relates to an opening means for containers and packages which can be opened by a one-touch operation.

2. Description of the Prior Art

Heretofore, in sealed containers or packages of cigarettes, chocolates and other foods and soft drinks, a tear tape, a string or a like substance which is different from the material of the container or package is adhered in the vicinity of the part to be opened, and when the container or package is to be opened, the tear tape or the like is usually pulled to partially tear or completely peel off the container or package due to the strength of the material thereof.

In practice, however, a tear tape and the like are often broken in the course of opening the container or the package, resulting in an extreme difficulty in a one-touch opening of of the container and the like. Moreover, such a tear tape or the like is provided to the container or package when sealed, resulting in a complication of the manufacture of these containers and packages. In any event, the prior art tear tapes and the like are defective from a number of standpoints.

SUMMARY OF THE INVENTION

Accordingly, this invention provides an opening means for containers and packages comprising a novel and extremely handy structure for opening, free from the defects in the prior art, and an object of this invention is to facilitate and ensure opening of containers and the like and at the same time to simplify the manufacture thereof and to improve the appearance of the goods.

More precisely, this invention provides an opening means for containers and packages comprising a sheet containing at least one crystalline thermoplastic high molecular weight resin layer, the resin layer being partially uniaxially oriented, and of a tab integrated with the sheet to be pulled up in the uniaxially oriented direction, the sheet being applied to an area or part of the containers and packages to be opened.

BRIEF DESCRIPTION OF THE ACCOMPANYING DRAWINGS

FIG. 1 is an explanatory plan to show how a sheet-like lid is applied to a cylindrical container.

FIG. 2 is an oblique plan view of a sealed container in the state of being opened.

FIG. 3 is an explanatory plan view of a package sheet to show the state of being opened.

FIG. 4 is an oblique plan view of a container with a lid.

DESCRIPTION OF PREFERRED EMBODIMENTS

Now, the present invention will be explained in detail with reference to the drawings attached hereto.

With reference to FIG. 1, 1 is a cylindrical container body and, in the part thereof to be opened, sheet-like lid 2 or 2' is integrally adhered with an adhesive. The shape of container 1 is not necessarily cylindrical but can be pillar-shaped or the like. In any event, the shape of the container is not limited, and the container can have any and all configurations. In addition, the material of the container is not limited, and any of plastics, glass, paper, metals and composites can be used therefor. In addition, the sheet-like lid 2 or 2' can be integrated with the container body 1 under heat or pressure, in place of the use of an adhesive. Alternatively, the lid can be integrated with the container by coating or applying polyethylene, waxes or other substances having a low melting point.

The shape of the lid 2 or 2' must necessarily correspond to that of the opening part 3 of the container 1. The lid can be previously cut out or stamped out to form the desired shape, or alternatively, the lid can be stamped out correspondingly after integration with the container. The lid 2 or 2' is made of a single layer sheet or multiple layer sheet, and at least one layer thereof must be a crystalline thermoplastic high molecular weight resin sheet which is partially uniaxially oriented (that is, the degree of molecular orientation in the sheet is higher at least in one axial direction than in the other axial direction). For the uniaxially oriented sheet, crystalline thermoplastic high molecular weight resins such as polyolefins, for example, polypropylene, polyethylene and copolymers thereof, polyvinyl chloride, polyvinylidene chloride, polyamides, polyesters or copolymers thereof, and mixtures of these polymers and copolymers, more specifically, high density polyethylene having a melt index of about 0.1 to 20 g/10 min, preferably 0.3 to 2.0 g/10 min, and polypropylene having a melt index of about 1 to 20 g/10 min, preferably 4 to 10 g/10 min, can be used in the present invention, the determination of the melt index being according to ASTM D-1238-57T. With respect to the crystallinity, a polyethylene having a degree of crystallinity of about 75 to 95 (the polyethylene having a melting point of 126° to 140°C and a crystalline particle size of about 300 to 400 A), and polypropylene having an isotactic index of higher than about 50, preferably 80 to 95, can be suitably used in the present invention. Further, with respect to the degree of uniaxial stretching, high density polyethylene having a degree of uniaxial stretching of about 3 to 10, preferably 5 to 8, and polypropylene having a degree of uniaxial stretching of about 2 to 9, preferably 5 to 8, can be used in the present invention. The materials of the other sheets to be adhered with the uniaxially oriented resin sheet are, for example, nonoriented plastic films, and paper, metal foil and the like. When the sheet-like lid 2 or 2' is made of two or more layers, at least one of the layers must necessarily be the above-described uniaxially partially oriented sheet. Various known means can be utilized for adhering these sheets, such as a continuous adhering method using extrusion lamination, a dry lamination method and a heat-adhering method.

In a part of the sheet-like lid 2 or 2', or in the periphery 4 thereof corresponding to the opening part 3 of the container body, a tab to be pulled up in the uniaxially oriented direction is formed. The tab can be a projection 5, or alternatively, slight notches 6 can be formed in the periphery 4 to form a tab 5' therebetween. When the tab 5 or 5' is pulled up in the uniaxially oriented direction (as shown by the arrow in FIG. 1), the sheet-like lid 2 or 2' is opened as shown in FIG. 2.

FIG. 3 shows a package sheet 7 which envelops a container 8 with lid 9 (FIG. 4), for example, for cigarettes or chocolates. In this case, the lid 9 of the container is opened as shown in FIG. 4, and so, the package sheet 7 must be so applied to envelop the container 8 that the above-described uniaxially oriented direction of the sheet 7 corresponds to the direction encircling the side surface of the container 8. The package sheet 7 has a tab 10 to be pulled up in the uniaxially oriented direction which is formed in the part corresponding to the opening part thereof, analogously to the above-described embodiment. When the package is to be opened or peeled off, the tab 10 is continuously pulled up in the uniaxially oriented direction (shown by the arrow in FIG. 3) to wholly circle the side surface of the container 8, whereby the package sheet 7 is divided into two upper and lower parts and thereafter the cap 9 of the container can be opened as shown in FIG. 4. It is a matter of course that the projecting tab 10 can be replaced by another type with two slight notches, analogously to the above-described embodiment.

As explained above in detail, the opening means of the present invention comprises a sheet containing at least one crystalline thermoplastic high molecular weight resin layer, the resin layer being partially uniaxially oriented, and of a tab-integrated with the sheet to be pulled up in the uniaxially oriented direction, the sheet being applied to a part or area of the container and package to be opened. The previously described physical characteristics can be considered to be sufficient for the sheet as long as the force to pull the tab and tear the film is not greater than 70 g/cm. The advantages of the present invention resulting from this structure are as follows. When the tab integrally formed in the sheet-like lid or package sheet is pulled up, the part of the sheet-like lid and package sheet to follow the tab is torn in the uniaxially oriented direction, resulting in a simple and sure opening of the container and package in a one-touch operation. Moreover, the tab itself corresponds to a part of the sheet-like lid and package sheet, being different from a tear tape, a string and like substances which are made of materials different from those of the container and package bodies themselves, and therefore, manufacture of sealed containers can be simplified and is inexpensive since the step for providing a tear tape, a string or a like substance to containers can be omitted. In addition, the opening means of the present invention is free from problems that the tear tape and the like are broken in the course of tearing of containers and packages. Furthermore, the materials utilized for the sheet are crystalline thermoplastic high molecular weight resins, which have excellent characteristics of waterproof properties, printability, light weight, low combustibility, smokeless combustion, moisture-proof properties and sanitation for foods.

The present invention is illustrated in greater detail by reference to the following example.

EXAMPLE

Container: cylindrical container made of polypropylene, size: 70 mm$\phi$ × 100 mm, thickness of cylindrical wall: 0.5 mm Sheet-like Lid: Circular lid (diameter: 71 mm) of Yupo FP No. 80 (trade name by Oji-Yuka Synthetic Paper Co., Ltd.) comprising a three-layer laminate of biaxially oriented polypropylene film (degree of stretching in the lateral direction: about 8 times; degree of stretching in the longitudinal direction: about 5 times) and uniaxially oriented polypropylene film (degree of stretching in the lateral direction: about 8 times), with a tab (width: 5 mm; length: 10 mm)

Adhesion Means: The lid is integrally adhered to the opening part of the container with an adhesive (SR-690, trade name, produced by Saiden Kagaku Co., Ltd.)

A sealed container was prepared as described above, and the tab thereof was pulled up in the uniaxially oriented direction, whereby the sheet-like lid was torn into two parts in the central part thereof starting from the tab. Thus, the container could be opened surely and easily.

While the invention has been described in detail and with reference to specific embodiments thereof, it will be apparent to one skilled in the art that various changes and modifications can be made therein without departing from the spirit and scope thereof.

What is claimed is:

1. An opening means for containers and packages comprising a sheet containing at least one crystalline thermoplastic high molecular weight resin layer, said resin layer being a laminated composite comprising a uniaxially oriented film and a biaxially oriented film, and a tab integrated with said sheet to be pulled up in the uniaxially oriented direction, the sheet being applied to a part of the container and package to be opened.

2. The opening means as claimed in claim 1, wherein said tab is a projection.

3. The opening means as claimed in claim 1, wherein said tab is formed by two slight notches in the periphery of the sheet.

4. The opening means as claimed in claim 1, wherein said crystalline thermoplastic high molecular weight resin is selected from the group consisting of polyolefins, polyvinyl chloride, polyvinylidene chloride, polyamides, polyesters or copolymers thereof and mixtures thereof.

5. The opening means as claimed in claim 4, wherein said crystalline thermoplastic high molecular weight resin is selected from the group consisting of polypropylene, polyethylene and copolymers thereof.

6. The opening means as claimed in claim 1, wherein said resin mainly comprises polypropylene.

7. The opening means as claimed in claim 1, wherein said resin layer is a laminated composite comprising a biaxially oriented film and a uniaxially oriented film on each surface of said biaxially oriented film.

8. The opening means as claimed in claim 7, wherein said resin mainly comprises polypropylene.

9. The opening means of claim 1 wherein said crystalline thermoplastic high molecular weight resin is high density polyethylene having a melt index of about 0.1 to 20 g/10 min, or polypropylene having a melt index of about 1 to 20 g/10 min.

10. The opening means of claim 1 wherein said crystalline thermoplastic high molecular weight resin is a polyethylene having a degree of crystallinity of about 75 to 95, and a degree of uniaxial stretching of about 3 to 10, or polypropylene having an isotactic index of higher than about 50, and having a degree of uniaxial stretching of about 2 to 9.

* * * * *